United States Patent [19]

Altman

[11] 4,383,341

[45] May 17, 1983

[54] BATHTUB SELF-CLEANING SYSTEM

[76] Inventor: Murray Altman, 1560 Palisade Ave., Fort Lee, N.J. 07024

[21] Appl. No.: 250,428

[22] Filed: Apr. 2, 1981

[51] Int. Cl.[3] ..... A47K 4/00; E03C 1/01

[52] U.S. Cl. ..... 4/662; 4/490; 4/538; 4/541; 4/661; 128/66; 134/100; 134/167 R; 134/168 R

[58] Field of Search ..... 4/662, 628, 661, 541, 4/538, 542, 543, 546, 233, 622, 621, 584, 490; 128/66, 371; 134/100, 167 R, 168 R; 239/590.3

[56] References Cited

U.S. PATENT DOCUMENTS

| | | | |
|---|---|---|---|
| 2,575,636 | 11/1951 | Patch | 4/541 X |
| 2,705,329 | 4/1955 | Exton-Porter | 4/584 |
| 3,027,568 | 4/1962 | Blau et al. | 4/615 |
| 3,045,829 | 7/1962 | Rule et al. | 4/490 X |
| 3,381,312 | 5/1968 | Whitla | 4/662 |
| 3,396,412 | 8/1968 | Francom | 4/542 |
| 3,662,406 | 5/1972 | Giglio | 4/541 X |
| 3,713,176 | 1/1973 | Stock | 4/662 |
| 3,720,961 | 3/1973 | Garvey | 4/662 |
| 3,742,520 | 7/1973 | Bernardi | 4/662 |
| 3,747,129 | 7/1973 | Dyar | 4/662 |
| 3,752,156 | 8/1973 | Wack | 128/66 |
| 3,755,826 | 9/1973 | Roberts | 4/662 |
| 3,837,011 | 9/1974 | McTighe et al. | 4/662 |
| 3,869,732 | 3/1975 | Garvey et al. | 4/662 |
| 3,943,951 | 3/1976 | Spotz | 134/100 |
| 3,967,323 | 7/1976 | Serio | 4/541 |
| 4,063,316 | 12/1977 | Hunninghaus | 4/233 |
| 4,233,692 | 11/1980 | Sinsley | 4/662 |
| 4,301,558 | 11/1981 | Decaux | 4/662 |
| 4,345,343 | 8/1982 | Shipman | 4/661 |

FOREIGN PATENT DOCUMENTS

| | | | |
|---|---|---|---|
| 3022778 | 12/1981 | Fed. Rep. of Germany | 4/662 |

*Primary Examiner*—Henry K. Artis

*Attorney, Agent, or Firm*—Lerner, David, Littenberg & Samuel

[57] ABSTRACT

A bathtub self-cleaning system includes a series of pop-out spray nozzles designed to be arranged about the confining walls of a bathtub and the like. The spray nozzles are connected by a manifold to a combined concentrate and dilutent mixing control valve. The control valve serves to initially mix the dilutent such as water with the concentrate such as a detergent to provide a diluted cleaning solution. Subsequently, the control valve discharges the cleaning solution via the manifold through the spray nozzles. The spray nozzles when popped-out are directed at the surfaces of the confining walls for their cleaning by the cleaning solution. Upon consumption of the concentrate within the mixing control valve, only dilutent is discharged therefrom to rinse the confining walls of residual cleaning solution or dirt. In this manner, a bathtub may be automatically cleaned without the necessity of any manual scrubbing thereof.

15 Claims, 6 Drawing Figures

BATHTUB SELF-CLEANING SYSTEM

BACKGROUND OF THE INVENTION

The present invention relates in general to a bathtub cleaning system, and more particularly, to a self-cleaning system for bathtubs and the like having a cleaning and rinse cycle controlled by a mixing control valve.

Lavatories, such as bathtubs, showers and the like, often require daily cleaning due to health and general sanitation standards. This is particularly true of bathtubs found in hotels and motels which must be cleaned on a daily basis. Heretofore, the task of cleaning such bathtubs have been accomplished by manual labor. As a result of the increasing cost of manual labor and the undesirability of performing such tasks, attempts have been made to improve the cleaning operation of these bathtubs.

In particular, the prior art has addressed the problem of the daily cleaning of public and private restroom facilities which have included cleaning the commodes, bathtubs, showers, walls, etc. Such attempts have included the design of cleaning machines and complicated cleaning systems suspended from the ceiling. However, these systems have not gained commercial acceptance due to their expense and cumbersome use.

Accordingly, there is an unsolved need for a self-cleaning system which is economical and easy to use for cleaning bathtubs and the like.

SUMMARY OF THE INVENTION

It is broadly an object of the present invention to provide a bathtub self-cleaning system which fulfills one or more of the foregoing requirements of bathtub cleaning systems and which overcomes or avoids one or more of the foregoing disadvantages from the use of the prior art restroom facility cleaning systems. Specifically, it is within the contemplation of the present invention to provide a bathtub self-cleaning system which automatically cleans bathtubs without the necessity of any manual scrubbing thereof.

A further object of the present invention is to provide a bathtub self-cleaning system which provides a cleaning cycle and a rinse cycle from a common mixing control valve.

A still further object of the present invention is to provide a bathtub self-cleaning system which is adapted to combine a predetermined amount of a concentrate with a dilutent to form a cleaning solution for use during a cleaning cycle.

A still further object of the present invention is to provide a bathtub self-cleaning system which supplies a cleaning agent and rinse at a predetermined rate to a mixing chamber within a mixing control valve to form a cleaning solution for cleaning the walls of a bathtub.

A yet still further object of the present invention is to provide a bathtub self-cleaning system for cleaning the surfaces of the confining walls of a bathtub in an uncumbersome and inexpensive manner.

In accordance with one embodiment of the present invention, there is provided a system for cleaning the walls of a bathtub. The system includes a plurality of spray nozzles adapted to be arranged to distribute a cleaning solution and dilutent over the walls of a bathtub to be cleaned. A fluid conduit means is provided to communicate with each of the spray nozzles for supplying the cleaning solution and dilutent thereto from a control means. The control means is constructed and arranged to combine a concentrate with the dilutent to provide the cleaning solution for use in cleaning the walls of the bathtub during a first cycle and to provide the dilutent for rinsing the walls of the bathtub during a second cycle.

Further in accordance with the above embodiment, the control means includes a first chamber for supplying a quantity of concentrate, a second chamber for supplying a quantity of dilutent and a third chamber for combining a quantity of concentrate supplied from the first chamber with a quantity of dilutent supplied from the second chamber to form the cleaning solution.

Still further in accordance with the above embodiment, the first and second chambers include an orifice member having an opening of predetermined size to supply a predetermined quantity of concentrate and dilutent from the first and second chambers into the third chamber.

Further in accordance with the present invention there is provided a cleaning system for a bathtub including a series of spray nozzles adapted to be arranged around the walls of the bathtub. The spray nozzles have piston elements movable between a first stored position and a second operative position. A fluid conduit means is provided to communicate with each of the spray nozzles for supplying a solution thereto. Control means are provided for supplying the solution to the fluid conduit means. The spray nozzles are constructed and arranged to move the piston elements from the first position to the second position in response to the solution for distributing the solution over the walls of the bathtub during a first interval and to move the piston elements from the second position to the first position at the end of the first interval.

Still further in accordance with the present invention, there is provided a mixing control valve for combining a concentrate with a dilutent to provide a diluted solution. The control valve is construced from a body having an inlet, an outlet and first, second, and third chambers. The first chamber is provided to supply a quantity of concentrate and the second chamber to supply a quantity of dilutent to the third chamber. The third chamber is in communication with the first and second chambers for combining a quantity of concentrate from the first chamber with a quantity of dilutent from the second chamber to provide the diluted solution. The inlet is arranged in communication with the first and second chambers for supplying the dilutent thereto and the outlet with the third chamber for supplying the dilute solution therefrom.

Further in accordance with the last mentioned embodiment, there is provided an injection port communicating directly with the first chamber for introducing the concentrate therein from a storage bottle.

BRIEF DESCRIPTION OF THE DRAWINGS

The above description as well as further objects, features and advantages of the present invention will be more fully understood by reference to the following detailed description of a presently preferred, but nonetheless illustrative bathtub self-cleaning system in accordance with the present invention when taken in conjunction with the accompanying drawings, wherein.

DETAILED DESCRIPTION

Figure 1:
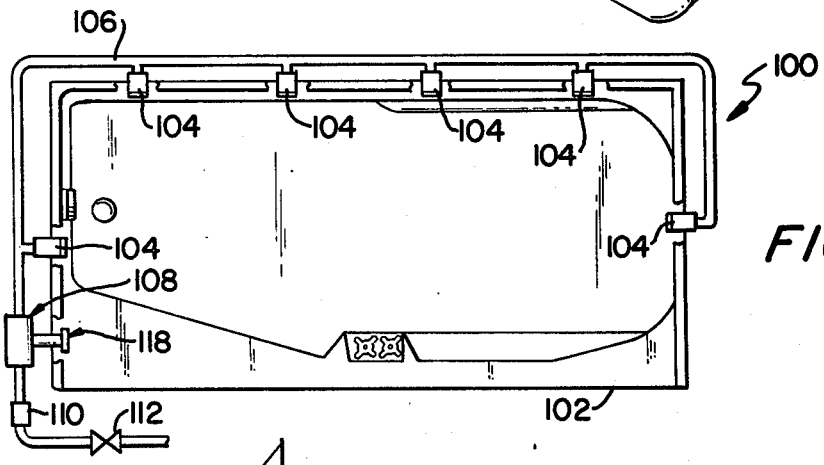
FIG. 1 is a front elevation of a bathtub self-cleaning system installed on a bathtub showing a plurality of pop-out spray nozzles connected to a manifold for supplying a cleaning solution and rinse from a mixing control valve.

Referring specifically to the drawings, there is shown in FIG. 1, a bathtub self-cleaning system constructed according to one embodiment of the present invention and generally designated by reference numeral 100. Although the system 100 is shown with reference to a bathtub 102, it is to be understood that such a system may be incorporated into a shower, a swimming pool or the like. The system 100 is constructed to include a plurality of pop-up spray nozzles 104, a fluid conduit or manifold 106 and a mixing control valve 108 having an injection port 118. In addition, the system 100 can be provided with an external check valve 110 and a manually or solenoid activated supply valve 112.

Figure 2:
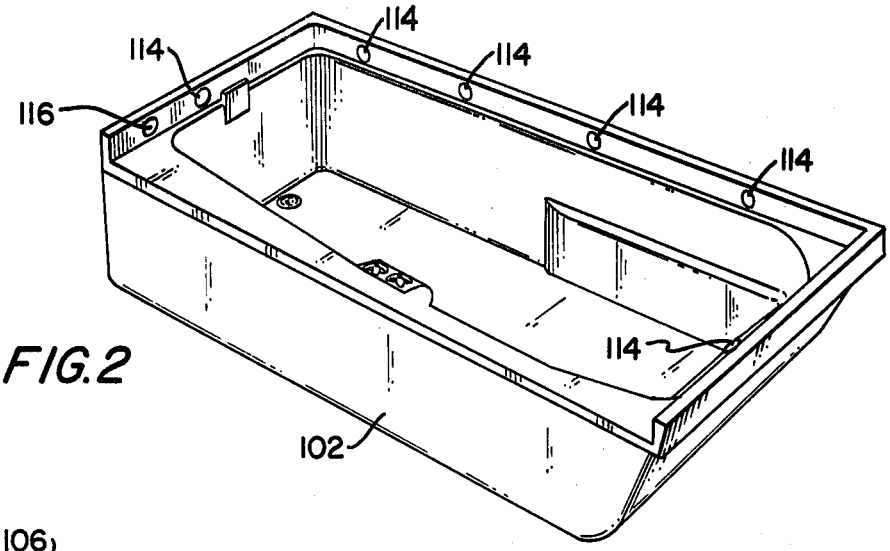
FIG. 2 is a perspective elevation of the bathtub as shown in FIG. 1 having a plurality of apertures for installing the spray nozzles as shown in FIG. 1.

As shown in FIG. 1, the spray nozzles 104 are secured around the walls of the bathtub 102 within apertures 114 (see FIG. 2). The spray nozzles 104 are positioned to distribute a cleaning solution and a dilutent such as rinse water over selected surface portions of the walls of the bathtub 102 during a cleaning and rinse cycle. The manifold 106 communicates with each of the spray nozzles 104 to supply the cleaning solution and rinse thereto from the control valve 108. The manifold 106 can be located below the upper lip of the bathtub 102 to position it out of eyesight upon installation. The control valve 108 is secured adjacent to the wall of the bathtub 102 in alignment with aperture 116 (see FIG. 2).

Figure 3:
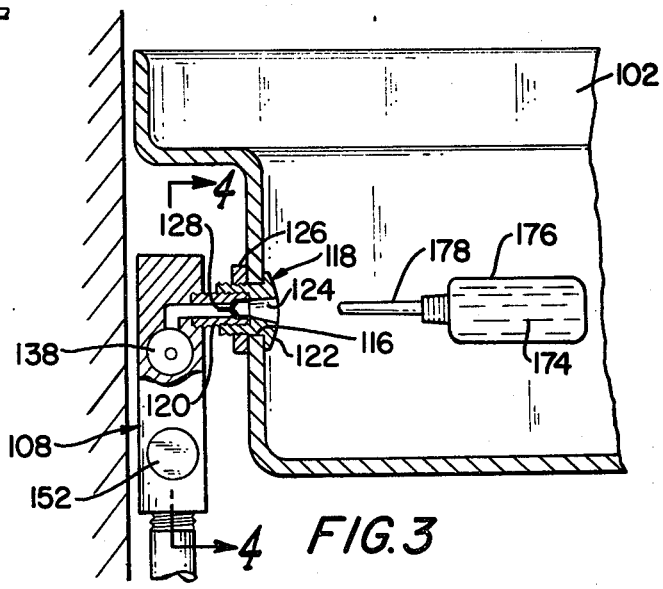
FIG. 3 is a partial, cross-sectional, side elevation showing the mixing control valve as shown in FIG. 1 installed to the wall of the bathtub and having means for injecting a cleaning agent therein.

The construction of the control valve 108 will now be described with reference to FIGS. 3 and 4. Referring specifically to FIG. 3, the control valve 108 is secured to the bathtub 102 via the injection port 118. The injection port 118 is constructed from a hollow tubular nipple 120 having external threads. One end of nipple 120 is secured within the body of the control valve 108. The other end is secured to the wall of the bathtub 102 by a wall fitting 122 having internal threads for engaging the external threads of nipple 120. Wall fitting 122 includes a central opening 124 in communication with the opening at the end of nipple 120. Wall fitting 122 is secured to the bathtub 102 within aperture 116 by a locknut 126. A resilient flexible check valve 128 having a variable orifice is located within opening 124 of the wall fitting 122 and extends inward into nipple 120. The operation of the injection port 118 will be described hereinafter with reference to the operation of the bathtub self-cleaning system.

Figure 4:
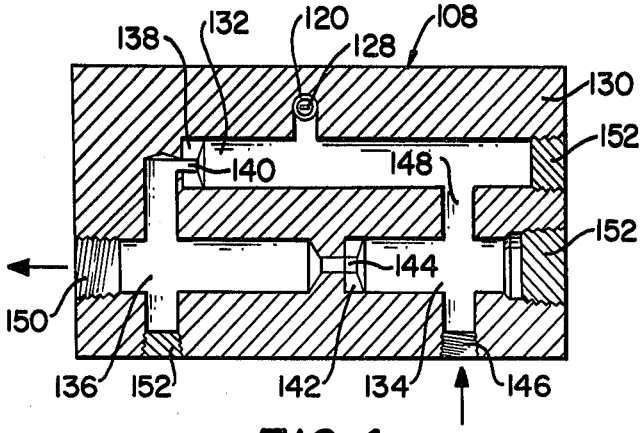
FIG. 4 is a cross-sectional elevation taken along lines 4—4 of FIG. 3 showing the mixing control valve having a first cleaning agent chamber, a second rinse chamber and a third mixing chamber for combining the cleaning agent with the rinse to form a cleaning solution.

Referring to FIG. 4, the control valve 108 is constructed from a body 130 having a first concentrate or cleaning agent chamber 132, a second dilutent or rinse chamber 134 and a third mixing chamber 136. Secured within one end of the cleaning agent chamber 132 is a flow control orifice member 138 having a restricted opening 140 of predetermined size. Likewise, secured within one end of the rinse chamber 134 is an orifice member 142 having a restricted opening 144 of predetermined size. The openings 140, 144 within orifice members 138, 142 provide direct communication from the cleaning agent chamber 132 and rinse chamber 134 to the mixing chamber 136. Orifice members 138, 142 can be constructed permanently within the cleaning agent chamber 132 and rinse chamber 134 or can be constructed from a replaceable body to alloy for the easy changing of the size of openings 140, 144.

An inlet 146 is located at one side of the control valve 108 to provide a supply of rinse to the rinse chamber 134 and cleaning agent chamber 132 by interconnecting passageway 148. An outlet 150 is located at one end of the control valve 108 in communication with the mixing chamber 136. The injection port 118 communicates directly with the cleaning agent chamber 132 via nipple 120 and check valve 128. Plugs 152 are secured within one open end of the cleaning agent chamber 132, rinse chamber 134 and mixing chamber 136 to provide internal access thereto. The plugs 152 allow for the cleaning of the cleaning agent chamber 132, rinse chamber 134 and mixing chamber 136, in addition to allowing replacement and repair of orifice members 138, 142.

Figure 5:
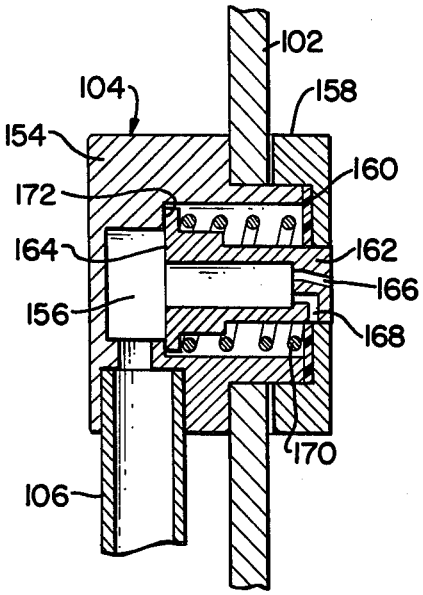
FIG. 5 is a cross-sectional elevation of a pop-out spray nozzle as shown in FIG. 1 having horizontal and verticle spray orifices.

The construction of the pop-out spray nozzles 104 will now be described with reference to FIGS. 5 and 6. The spray nozzles 104 are constructed of a body 154 having a cavity 156 therein. The body 154 has an open end extending through aperture 114 within the bathtub 102 and is secured thereto by a cap 158 having a central opening therein. A gasket 160 provides a leak proof seal between the internal region of cap 158 and the open end of the body 154.

Figure 6:
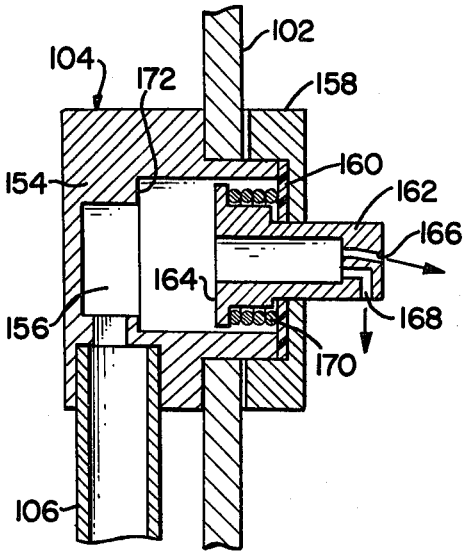
FIG. 6 is a cross-sectional elevation of the spray nozzle, as shown in FIG. 5 in an operative popped-out position, for supplying the cleaning solution to the wall of the bathtub.

A hollow piston nozzle element 162 is slidably located within cavity 156 between a first stored position (see FIG. 5) and a second operative position (see FIG. 6). The piston nozzle element 162 includes a flange 164 at one end and one or more orifices 166, 168 provided at the other end. The end of the piston nozzle element 162 containing orifices 166, 168 is arranged for sliding engagement within the central opening of cap 158. A spring 170 is provided in the cavity 156 between the gasket 160 and flange 164 of the piston nozzle element 162 to bias the flange 164 against a retaining lip 172 constructed in the body 154. The manifold 106 is connected to the body 154 of the spray nozzles 104 to provide a supply of cleaning solution and rinse to the cavity 156 and orifices 166, 168.

The operation of the bathtub self-cleaning system in accordance with the present invention will now be described with reference to FIGS. 1 and 3–6. A concentrated cleaning agent such as a detergent 174 is supplied within a squeeze bottle 176 having an injection tube 178 at one end. A predetermined quantity of detergent 174 is introduced into the cleaning agent chamber 132 of the control valve 108. This is accomplished by inserting the injection tube 178 through the flexible check valve 128 via central opening 124 in the injection port 118. As the injection tube 178 engages the internal portions of the check valve 128, the check valve is forced open to allow continued insertion of the injection tube to communicate with the cleaning agent chamber 132. Once a sufficient quantity of detergent 174 has been introduced into the cleaning agent chamber 132, the injection tube 178 is withdrawn and the check valve 128 closes, retaining the detergent therein.

The rinse is supplied to the inlet 146 of the control valve 108 from a suitable source of cold, hot or tepid water. Opening of valve 112 manually or by activation of the solenoid supplies the rinse to the rinse chamber 134 and cleaning agent chamber 132 via passageway 148. Check valve 110 prevents contamination of the rinse source with detergent 174 during operation of the system 100. The rinse is supplied to the mixing chamber 136 from the rinse chamber 134 at a controlled rate through the opening 144 in the orifice member 142. In a like manner, the detergent 174 is supplied to the mixing chamber 136 at a controlled rate through the opening 140 in the orifice member 138. The detergent 174 and rinse combine in the mixing chamber 136 to provide the diluted cleaning solution for use at outlet 150 of the control valve 108. In one embodiment, the orifice member 142 in the rinse chamber 134 provides a flow rate of 2.75 gallons per minute of rinse and the orifice member 138 in the cleaning agent chamber 132 provides a controlled flow rate of 0.25 gallons per minute of detergent 174.

The cleaning solution is supplied to each of the spray nozzles 104 through the manifold 106. The cleaning solution enters cavity 156 within each spray nozzle 104 and impinges upon flange 164 of the piston nozzle elements 162. As shown in FIG. 5, the piston nozzle elements 162 are normally biased by the spring 170 in a first stored position such that the end containing the orifices 166, 168 is flush with the outer surface of cap 158 and the other end having flange 164 is biased against the retaining lip 172 of the body 154. As shown in FIG. 6 the pressure of the cleaning solution forces the piston nozzle elements 162 to compress spring 170 such that the orifices 166, 168 at the end of the piston nozzle elements protrude beyond the outer surface of cap 158.

In one embodiment, those spray nozzles 104 which are provided along the side walls of the bathtub 102 include an orifice 166 having a horizontal spray pattern for cleaning the opposite sidewalls of the bathtub and a second orifice 168 having a downward spray pattern for cleaning the adjacent sidewall. Those spray nozzles 104 located at the opposite ends of the bathtub 102 are provided with a single orifice 168 having a downward spray pattern for cleaning the adjacent endwalls. It is to be understood by those skilled in the art that other spray patterns may be incorporated with the present invention for spraying the cleaning solution and rinse over the walls of the bathtub 102.

The cleaning solution is sprayed over the walls of the bathtub 102 until the detergent 174 has been consumed from the cleaning agent chamber 132, thus ending the cleaning cycle. Subsequently, the rinse is supplied to the spray nozzles 104 to remove any residual cleaning solution and dirt from the walls of the bathtub 102 during a rinse cycle. The rinse cycle continues until valve 112 is turned off isolating the control valve 108 from the rinse supply, i.e., water source. As shown in FIG. 5 when valve 112 is turned off, spring 170 forces the piston nozzle elements 162 to return to their first stored position having their ends flush with the outer surface of cap 158. The duration of the cleaning cycle can be altered by changing the size of opening 140 in the orifice member 138 located in the cleaning agent chamber 132. Likewise, the concentration of the cleaning solution can be altered by changing the size of opening 144 in the orifice member 142 located in the rinse chamber 134.

Although the invention herein has been described with reference to particular embodiments, it is to be understood that these embodiments are merely illustrative of the principles and application of the present invention. Thus, it is to be understood that numerous modifications may be made in the illustrative embodiments and other arrangements may be devised without departing from the spirit and scope of the present invention as defined by the appended claims. For example, the cleaning solution can be supplied to the manifold by using an aspirator to remove a predetermined quantity of detergent from a concentrate supply source for mixing with the dilutent flowing through the aspirator. A valve at the outlet to the concentrate supply source can be closed to allow pure rinse to flow through the aspirator and be sprayed on the walls of the bathtub. Cycle times for cleaning and rinse can be automatically adjusted by solenoid activated valves positioned within the bathtub self-cleaning system. In addition, the detergent may be eliminated from the control valve to provide only the dilutent for use in accordance with the bathtub self-cleaning system of the present invention.

What is claimed is:

1. A system for cleaning the walls of a bathtub comprising, a plurality of spray nozzles adapted to be arranged to distribute a cleaning solution and dilutent over the walls of a bathtub, fluid conduit means communicating with each of said spray nozzles for supplying the cleaning solution and dilutent thereto, and control means for supplying the cleaning solution and dilutent to said fluid conduit means, said control means constructed and arranged to combine a concentrate with the dilutent to form the cleaning solution for use in cleaning the walls of the bathtub during a first cycle and to provide the dilutent for rinsing the walls of the bathtub during a second cycle.

2. The system as set forth in claim 1 wherein said control means includes a first chamber for supplying a quantity of concentrate, a second chamber for supplying a quantity of dilutent and a third chamber for combining a quantity of concentrate supplied from said first chamber with a quantity of dilutent supplied from said second chamber to form the cleaning solution.

3. The system as set forth in claim 2 wherein said first chamber includes an orifice member having an opening therein for supplying a predetermined quantity of concentrate therefrom.

4. The system as set forth in claim 2 wherein said second chamber includes an orifice member having an opening therein for supplying a predetermined quantity of dilutent from said second chamber.

5. The system as set forth in claim 2 wherein said control means further includes means for introducing the quantity of concentrate into said first chamber.

6. A system for cleaning the walls of a bathtub comprising, a plurality of spray nozzles adapted to be arranged for distributing a cleaning solution and rinse over the walls of a bathtub, control means for supplying the cleaning solution to be distributed over the walls of the bathtub during a cleaning cycle and the rinse during a rinse cycle, said control means constructed and arranged to include a first chamber for supplying a quantity of a cleaning agent, a second chamber for supplying a quantity of rinse and a third chamber for combining a predetermined quantity of the cleaning agent supplied from said first chamber with a predetermined quantity of rinse as a dilutent supplied from said second chamber to form the cleaning solution, and a manifold communicating with each of said spray nozzles for supplying the cleaning solution and rinse from said third chamber to each of said spray nozzles during said cleaning and rinse cycles.

7. The system as set forth in claim 6 wherein said first chamber further includes an orifice member having an opening of predetermined size to supply the quantity of cleaning agent from said first chamber into said third chamber at a predetermined rate.

8. The system as set forth in claim 7 wherein said second chamber further includes an orifice member having an opening of predetermined size to supply the quantity of rinse from said second chamber to said third chamber at a predetermined rate.

9. The system as set forth in claims 7 and 8 wherein said orifice members are removable.

10. The system as set forth in claim 6 wherein said control means further includes a check valve communicating with said first chamber for introducing a predetermined amount of the cleaning agent therein to form the cleaning solution.

11. A self-cleaning bathtub for automatically cleaning the walls thereof comprising, a bathtub, a plurality of spray nozzles arranged around the walls of said bathtub for distributing a cleaning solution and rinse over a substantial portion of the walls of said bathtub, a manifold communicating with each of said spray nozzles for supplying the cleaning solution to said spray nozzles for cleaning the walls of said bathtub during a first cycle and the rinse for rinsing the walls of said bathtub during a second cycle, and a mixing control valve for supplying the cleaning solution and the rinse to said manifold during said first and second cycles, said mixing control valve constructed and arranged to include a first chamber for supplying a predetermined quantity of a concentrated cleaning agent through an orifice member having an opening of predetermined size for controlling the rate of supplying the cleaning agent therefrom, a second chamber for supplying a predetermined quantity of rinse through an orifice member having an opening of predetermined size for controlling the rate of supplying the rinse therefrom, and a third chamber for mixing the predetermined quantity of cleaning agent from said first chamber with the predetermined quantity of rinse as a dilutent from said second chamber to provide the cleaning solution, and a check valve in communication with said first chamber for introducing the predetermined quantity of the cleaning agent into said first chamber.

12. A cleaning system for a bathtub comprising, a series of spray nozzles adapted to be arranged around the walls of a bathtub, said spray nozzles having piston elements movable between a first stored position and a second operative position, fluid conduit means communicating with each of said spray nozzles for supplying a solution thereto, and control means for supplying the solution to said fluid conduit means, said spray nozzles constructed and arranged to move said piston elements from said first position to said second position in response to the solution for distributing the solution over the walls of the bathtub during a first interval and to move said piston elements from said second position to said first position at the end of said first interval.

13. The system as set forth in claim 12 wherein said control means includes a first chamber for supplying a quantity of concentrate, a second chamber for supplying a quantity of dilutent and a third chamber for combining a quantity of concentrate supplied from said first chamber with a quantity of dilutent supplied from said second chamber to form the solution.

14. The system as set forth in claim 13 wherein said control means includes a plug removably secured within one end of said first, second and third chambers to provide access thereto.

15. The system as set forth in claim 13 wherein said control means includes an inlet in communication with said first and second chambers and an outlet in communication with said third chamber.

* * * * *